US007824003B2

(12) United States Patent
Studer et al.

(10) Patent No.: US 7,824,003 B2
(45) Date of Patent: Nov. 2, 2010

(54) FLUID-EJECTION DEVICE SERVICE STATION

(76) Inventors: Anthony D. Studer, c/o Hewlett-Packard Co., 1000 NE Circle Blvd., Corvallis, OR (US) 97330-4239; Donald Lee Michael, c/o Hewlett-Packard Co., 1000 NE Circle Blvd., Corvallis, OR (US) 97330-4239; Kevin E. Swier, c/o Hewlett-Packard Co., 1000 NE Circle Blvd., Corvallis, OR (US) 97330-4239

( * ) Notice: Subject to any disclaimer, the term of this patent is extended or adjusted under 35 U.S.C. 154(b) by 782 days.

(21) Appl. No.: 11/807,469

(22) Filed: May 29, 2007

(65) Prior Publication Data

US 2008/0204503 A1 Aug. 28, 2008

Related U.S. Application Data

(63) Continuation-in-part of application No. 11/679,643, filed on Feb. 27, 2007.

(51) Int. Cl.
*B41J 2/165* (2006.01)

(52) U.S. Cl. ..... 347/22; 347/23; 347/32

(58) Field of Classification Search ..... 347/22, 347/23, 29, 32, 33, 20, 108, 109
See application file for complete search history.

(56) References Cited

U.S. PATENT DOCUMENTS 6,015,211 A * 1/2000 Kinoshita et al. ..... 347/109
6,568,780 B2 * 5/2003 Schantz et al. ..... 347/14
6,874,862 B2 * 4/2005 Shade ..... 347/40

* cited by examiner

*Primary Examiner*—Juanita D Stephens

(57) ABSTRACT

A service station for use with a fluid ejection device having a fluid-ejection mechanism with at least one nozzle includes a housing configured to attach to the fluid-ejection mechanism and to remain attached to the fluid-ejection mechanism during the fluid-ejection operation. A shutter arranged within the housing includes at least one opening, and is selectively moveable between a closed position and an open position with respect to the nozzle. In the open position the opening exposes the nozzle and in the closed position the nozzle is covered. An actuation mechanism separate from the housing is positioned to selectively couple with the shutter, such that activation of the actuation mechanism causes the shutter to move between the open and closed positions.

25 Claims, 14 Drawing Sheets

FLUID-EJECTION DEVICE SERVICE STATION

RELATED APPLICATIONS

This application is a Continuation-In-Part of and claims priority under 35 U.S.C. §120 to the previously filed and commonly assigned patent application entitled "Fluid-Ejection Device Service Station," filed on Feb. 27, 2007, and assigned Ser. No. 11/679,643.

BACKGROUND

Inkjet-printing devices, such as inkjet printers, are devices that eject ink onto media to form images on the media. Conventionally, an inkjet-printing device feeds media past an inkjet-printing mechanism, such as an inkjet printhead, in a first direction. The inkjet-printing mechanism moves relative to the media in a second direction perpendicular to the first direction, ejecting ink onto a swath of the media in accordance with a portion of the image to be formed. The inkjet-printing device advances the media so that a new swath is incident to the inkjet-printing mechanism, and the mechanism again moves relative to the media to eject ink onto this new swath. This process is repeated until the desired image is formed on the media.

By comparison, a handheld inkjet-printing device relies upon a user to move the device over a swath of media to properly eject ink onto the media to form a desired image. Such handheld inkjet-printing devices are useful in environments like shipping environments, for instance, in which tags, such as bar codes and other identifiers, are to be quickly imaged on media like packages. An example of such a handheld inkjet-printing device is described in the previously filed patent application entitled "Print Device Preconditioning," filed on Jan. 30, 2007, and assigned Ser. No. 11/669,149.

Inkjet-printing devices commonly need to be serviced. Such servicing can involve wiping inkjet-printing nozzles of the inkjet-printing mechanism, as well as spitting ink from the nozzles, to ensure that the nozzles properly eject ink when called upon to form an image on media. In a conventional inkjet-printing device, typically the inkjet-printing mechanism is moved to a service station within the device at which servicing is performed. The analog for a handheld inkjet-printing device is a docking station in which the device is placed while not being used to form an image on media. However, it can be inconvenient to expect the user to dock the handheld inkjet-printing device any time the device is not being used so that servicing can be performed.

DETAILED DESCRIPTION OF THE DRAWINGS

Figure 1A:
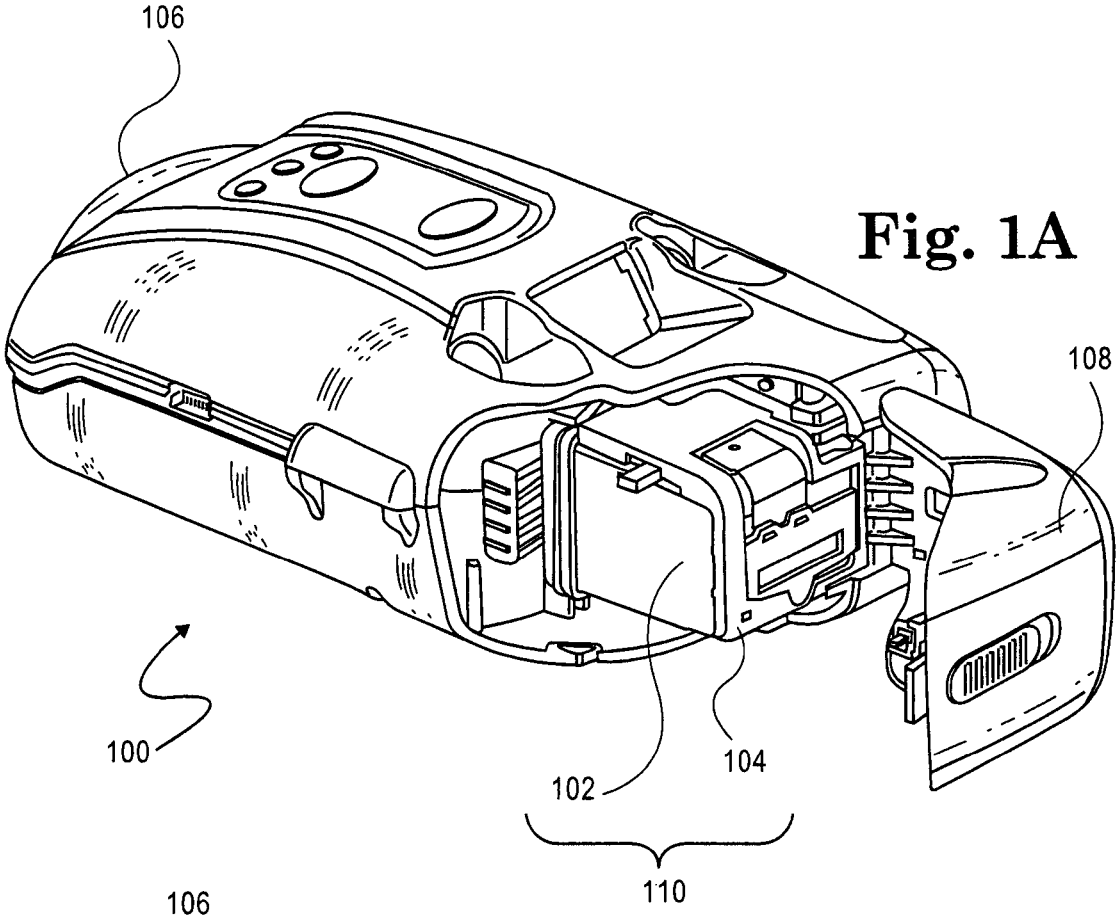
FIGS. 1A, 1B, and 1C are diagrams of a representative handheld fluid-ejection device, according to one embodiment.
Figure 1B:
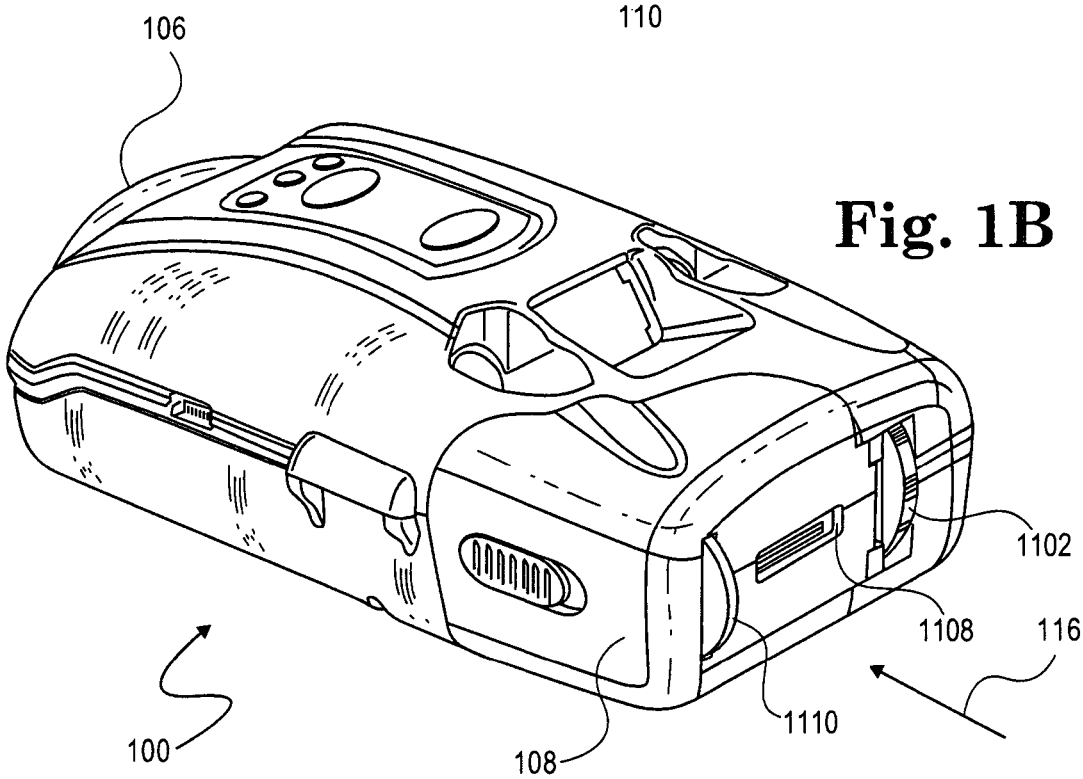
Figure 1C:
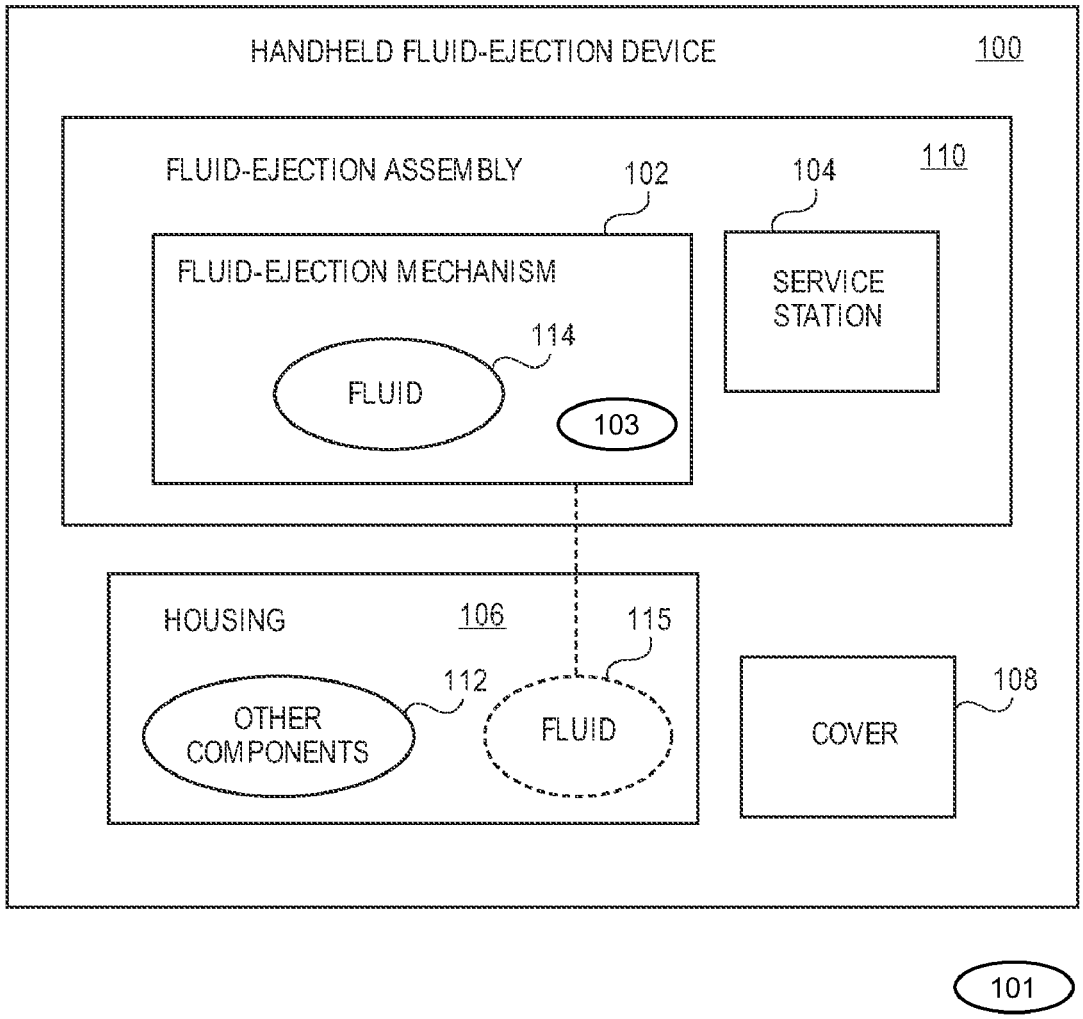

FIGS. 1A, 1B, and 1C show a representative handheld fluid-ejection device 100, according to an embodiment of the invention. Specifically, FIGS. 1A and 1B show perspective views of the handheld fluid-ejection device 100 with the cover 108 of the device 100 opened and closed, respectively. By comparison, FIG. 1C shows a block diagram of the handheld fluid-ejection device 100. It is noted that while certain components and mechanisms of the handheld fluid-ejection device 100 are particularly called out in FIGS. 1A, 1B, and 1C, the device 100 can and typically will include other components and mechanisms, in addition to and/or in lieu of those described herein.

The handheld fluid-ejection device 100 can in one embodiment be that which is described in the previously filed patent application entitled "Print Device Preconditioning," filed on Jan. 30, 2007, and assigned Ser. No. 11/669,149. The handheld fluid-ejection device 100 may in one embodiment be a handheld inkjet-printing device that ejects ink to form an image on media. The fluid-ejection device 100 is handheld in that a user holds the device 100 in his or her hand while the device 100 is ejecting fluid on media. Furthermore, the user moves the fluid-ejection device 100 so that the device 100 properly ejects fluid on the media so that, for instance, the device 100 properly forms an image on-the media. In other embodiments, the device 100 may have additional mounting features such that it can be used in different orientations but still ejects fluid in a similar manner, as can be appreciated by those of ordinary skill within the art. Furthermore, it is noted that the terminology media as used herein is generally considered to be any surface on which fluid is ejected by the fluid-ejection device 100. The term media, however, is not to be confused with the wiping mechanism and/or the capping mechanism, as to which these latter two terms are described in more detail later in the detailed description.

The handheld fluid-ejection device 100 includes a fluid-ejection mechanism 102 that is removably inserted into the device 100 when the cover 108 of the device 100 is opened. The fluid-ejection mechanism 102 may be an inkjet-printing mechanism, such as an inkjet printhead, and can include a supply of fluid 114, like ink, that is ejected from the mechanism 102. A service station 104 is removably or permanently affixed to the fluid-ejection mechanism 102. The service station 104 wipes the fluid-ejection mechanism 102 and caps the mechanism 102 during periods of nonuse, as is described in more detail later in the detailed description. The fluid-ejection mechanism 102 and the service station 104 may together be considered a fluid-ejection assembly 110. The fluid-ejection mechanism 102 may be a thermal fluid-ejection mechanism, such as a thermal inkjet mechanism, a piezoelectric fluid-ejection mechanism, such as a piezoelectric inkjet mechanism, or another type of fluid-ejection mechanism.

The handheld fluid-ejection device 100 further includes a housing 106 in which the fluid-ejection mechanism 102 is removably inserted. The housing 106 contains a number of other components 112. Generally, these components 112 control the fluid-ejection mechanism 102 to eject fluid onto media as the user moves the handheld fluid-ejection device 100. For example, such components 112 can include user-interface mechanisms like buttons and switches, semiconductor integrated circuits (IC's), encoders, imagers, sensors, as well as other types of components.

Generally, in operation the user holds the handheld fluid-ejection device 100 in one of his or her hands and positions the device -100 so that the surface indicated by the arrow 116 is pressed against the media on which the user wishes to eject fluid. The user then moves the fluid-ejection device 100 over the media. As the fluid-ejection device 100 is moved, the fluid-ejection mechanism 102 ejects fluid onto the media so that, for instance, a desired image is formed on the media.

It is noted that in another embodiment, the fluid ejection mechanism 102 may be an inkjet-printing mechanism, such as an inkjet printhead, where may be a separate supply of fluid 115 that is fluidically coupled to the printhead. This supply of fluid 115 may be located such that it can be attached directly to the fluid-ejection mechanism 102 or be located remotely within the handheld fluid ejection device 100.

Figure 2:
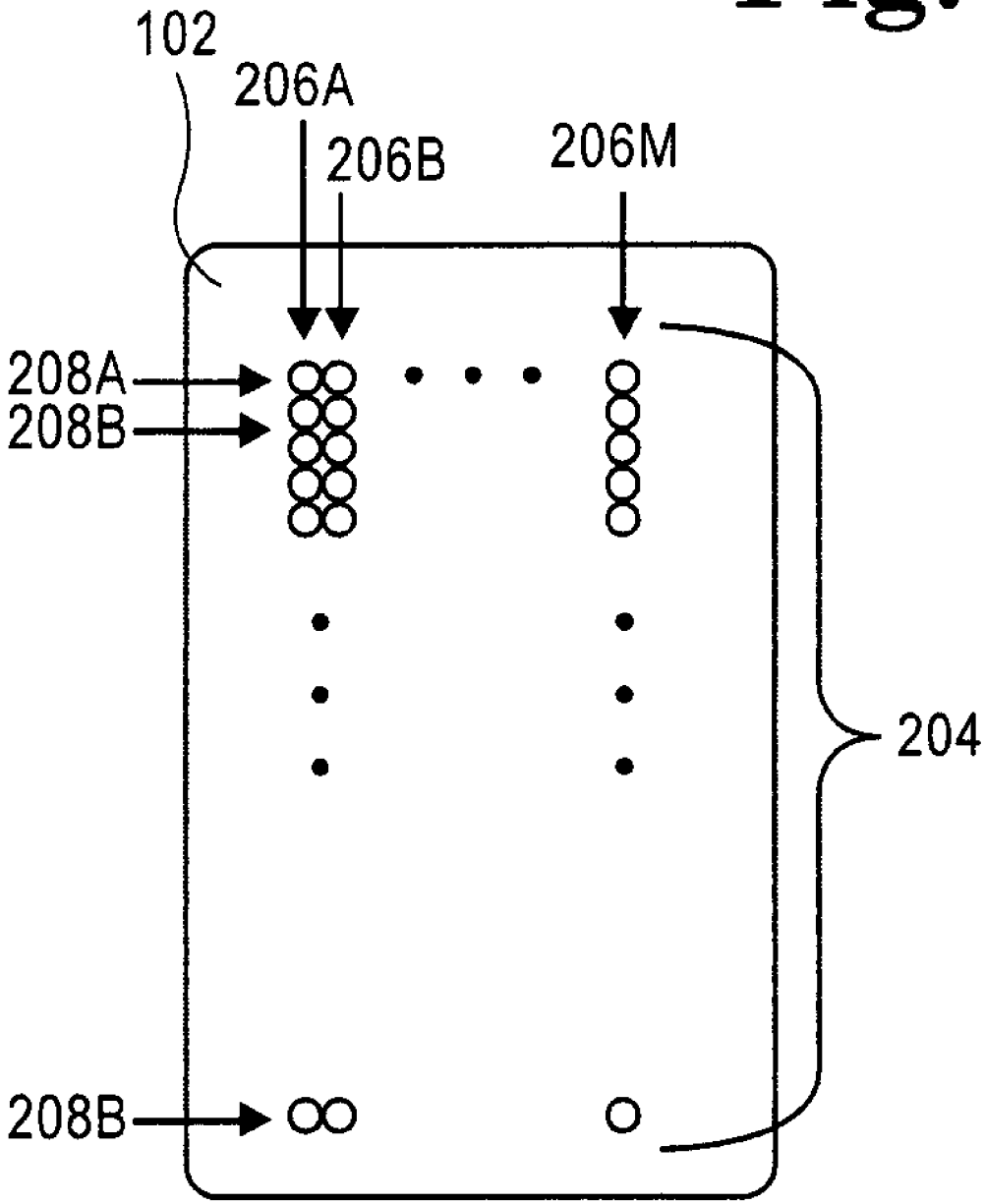
FIG. 2 is a diagram of a fluid-ejection mechanism having a number of fluid-ejection nozzles, according to an embodiment.

FIG. 2 shows a detailed view of the surface of the fluid-ejection mechanism 102 from which fluid is ejected, according to an embodiment of the invention. Particularly, the fluid-ejection mechanism 102 includes a number of fluid-ejection nozzles 204, such as inkjet nozzles. The fluid-ejection nozzles 204 are organized over a number of columns 206A, 206B, . . . , 206M, collectively referred to as the columns 206, and a number of rows 208A, 208B, . . . , 208N, collectively referred to as the rows 208. In one embodiment, for example, there may be 4 columns 206 and 168 rows 208, for a total of 672 fluid-ejection nozzles 204.

The fluid-ejection nozzles 204 are the orifices from which ink, or fluid, is ejected out of the fluid-ejection mechanism 102. The surface of the fluid-ejection mechanism 102 shown in FIG. 2 may be referred to as the orifice plate, which comes into close contact with media so that fluid can be precisely ejected from the fluid-ejection nozzles 204 onto the media in a desired manner. It is noted that the fluid-ejection nozzles 204 are organized in aligned columns 206 in the example of FIG. 2. However, in another embodiment, the fluid-ejection nozzles 204 may be organized in columns 206 such that adjacent columns are staggered relative to one another.

The fluid-ejection nozzles 204 of the fluid-ejection mechanism 102 can be susceptible to clogging by dried fluid that can degrade image quality, and the orifice plate of the mechanism 102 can also harbor dried fluid that can degrade image quality. Therefore, the fluid-ejection mechanism 102 is desirably periodically serviced, by wiping the fluid-ejection nozzles 204, for instance, to ensure that the nozzles 204 properly eject fluid. Likewise, the fluid-ejection nozzles 204 are desirably capped, or closed, during periods of nonuse of the fluid-ejection mechanism 102. Such servicing and capping are performed by the service station 104, different embodiments of which are now described in detail.

Figure 3A:
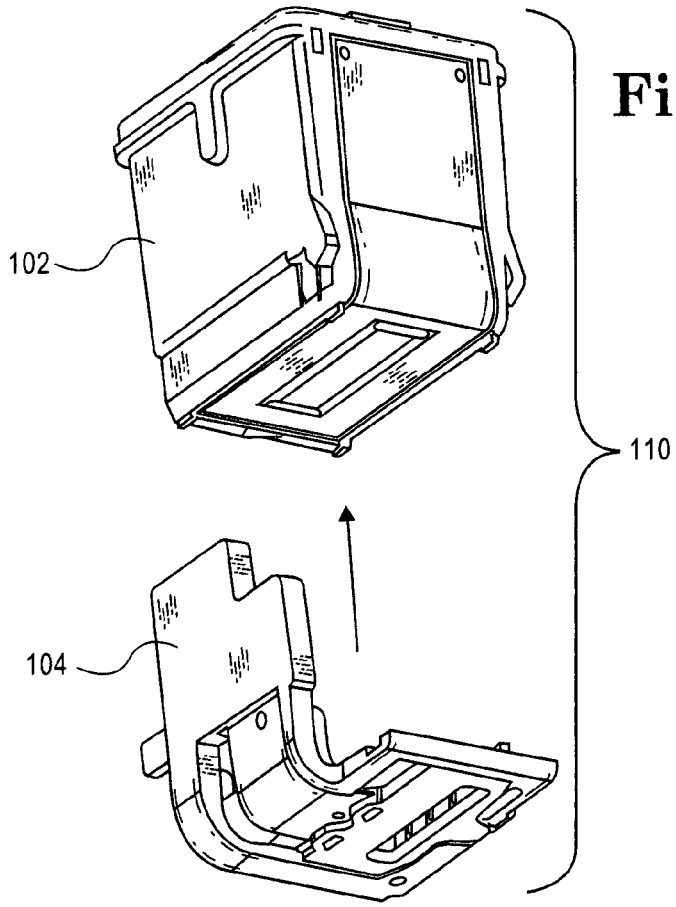
FIGS. 3A and 3B are diagrams of a fluid-ejection assembly including a fluid-ejection mechanism and a service station, according to one embodiment.
Figure 3B:
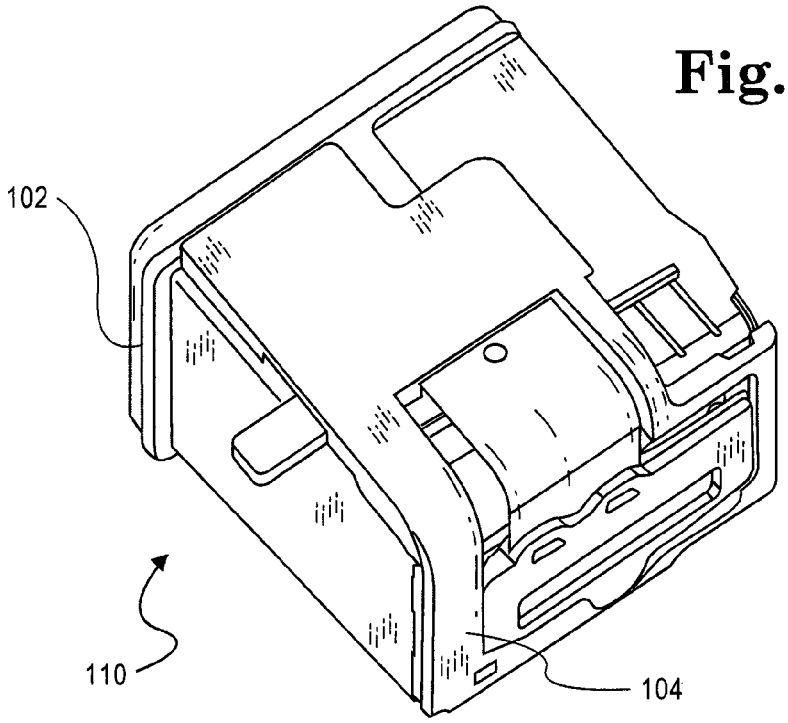

FIGS. 3A and 3B show the fluid-ejection assembly 110, according to an embodiment of the invention. The fluid-ejection assembly 110 includes the fluid-ejection mechanism 102 and the service station 104. In FIG. 3A, the service station 104 has been removed from the fluid-ejection mechanism 102. By comparison, in FIG. 3B, the service station 104 has been affixed to the fluid-ejection mechanism 102.

In one embodiment, the service station 104 is permanently affixed to the fluid-ejection mechanism 102, and cannot be removed after having been mounted to the fluid-ejection mechanism 102. Thus, when the fluid-ejection mechanism 102 needs replacing, such as, for instance, due to having run out of fluid, the entire fluid-ejection assembly 110 is removed from the fluid-ejection device 100 and replaced with a new assembly 110. The new fluid-ejection assembly 110 includes a new fluid-ejection mechanism 102 and a new service station 104 that has been permanently affixed to the mechanism 102.

By comparison, in another embodiment, the service station 104 is removably attached to the fluid-ejection mechanism 102, and can be removed after having been mounted to the fluid-ejection mechanism 102. Thus, when the fluid-ejection mechanism 102 needs replacing, the fluid-ejection assembly 110 is removed from the fluid-ejection device 100, and the service station 104 is removed from the old fluid-ejection mechanism 102. The service station 104 is then mounted to a new fluid-ejection mechanism 102, and the resulting fluid-ejection assembly 110—include the new mechanism 102 but the old service station 104—is inserted into the fluid-ejection device 100. In other embodiments, the service station 104 or fluid ejection mechanism 102 may be captured by the device 100 upon removal such that either or both the station 104 and the mechanism 102 can be later removed from device 100 and replaced.

Figure 4A:
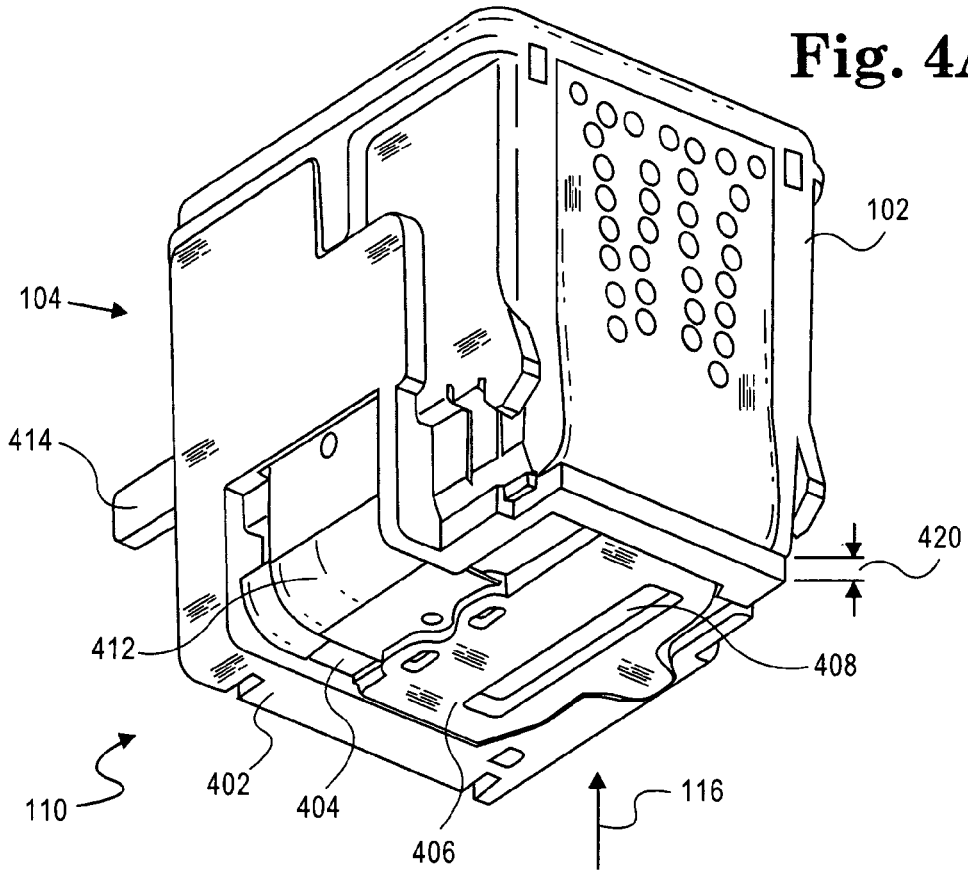
FIGS. 4A and 4B are diagrams of a service station for a fluid-ejection mechanism of a handheld fluid-ejection device, according to one embodiment.
Figure 4B:
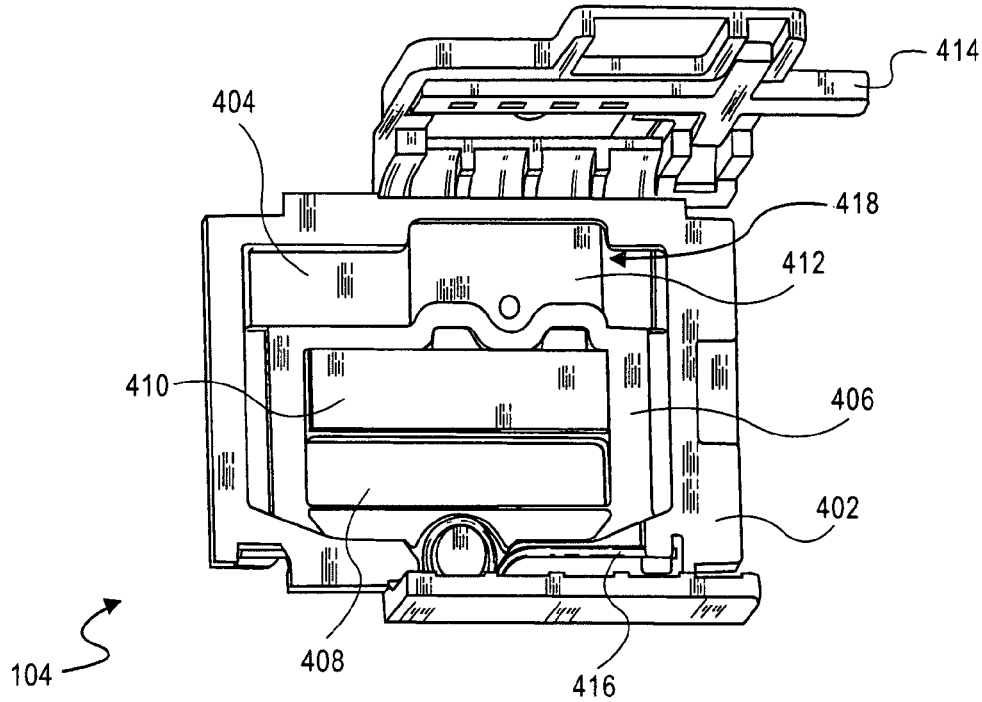

FIGS. 4A and 4B show the service station 104 in detail, according to an embodiment of the invention. In FIG. 4A, the service station 104 has been mounted on the fluid-ejection mechanism 102, such that the entire fluid-ejection assembly 110 is depicted. By comparison, in FIG. 4B, just the service station 104 is shown. In particular, in FIG. 4B, the side of the service station 104 that mounts to the fluid-ejection mechanism 102 is depicted. In another embodiment, the service station 104 may mount to additional sides of the fluid-ejection mechanism 102 as well.

The service station 104 includes an L-shaped housing 402 that mounts to the fluid-ejection mechanism 102. The housing 402 of the service station 104 can in one embodiment change the overall shape of the fluid-ejection assembly 110 such that the assembly 110 is substantially prevented from being inserted into the fluid-ejection device 100 incorrectly. That is, upon the service station 104 being mounted to the fluid-ejection mechanism 102, the fluid-ejection mechanism 102 can be attached to the fluid-ejection device 100 in just the correct way, preventing the user from incorrectly inserting the fluid-ejection assembly 110 into the device 100 incorrectly.

The housing 402 of the service station 104 defines an opening 404. A shutter 406 of the service station 104 is movably disposed within the opening 404 of the housing 402. The shutter 406 is more generally a wiping mechanism, and moves back and forth over the fluid-ejection mechanism 102, within the opening 404, to wipe the fluid-ejection mechanism 102. More specifically, the surface of the fluid-ejection mechanism 102 against which the shutter 406 is located in FIG. 4A is that which has been described in relation to FIG. 2 as including the fluid-ejection nozzles 204 of the fluid-ejection mechanism 102. Movement of the shutter 406 is thus back and forth over this surface of the fluid-ejection mechanism 102, and therefore over the fluid-ejection nozzles 204.

The shutter 406 of the service station 104 defines a slot 408. In the position of the shutter 406 within the opening 404 of the housing 402 depicted in FIG. 4A, the fluid-ejection nozzles 204 of the fluid-ejection mechanism 102 are not exposed through the slot 408. Rather, the fluid-ejection nozzles 204 are exposed through the slot 408 when the shutter 406 moves to the other side of the opening 404, which is indicated by the reference number 418 in FIG. 4B. Therefore, by moving the shutter 406 within the opening 404 back and forth between these two positions, the fluid-ejection nozzles 204 are alternately not exposed and exposed through the slot 408. When the fluid-ejection nozzles 204 are exposed through the slot 408, they are capable of ejecting fluid onto media as desired by a user.

As particularly depicted in FIG. 4A, the portion of the housing 402 that defines the slot 404 in which the shutter 406 is movably disposed, as well as the shutter 406 itself, add a distance 420 from the surface of the fluid-ejection mechanism 102 that includes the fluid-ejection nozzles 204 of FIG. 2. This surface, indicated by the arrow 116 and as has been described in relation to FIG. 1B, is pressed by the user against media to eject fluid onto the media. The distance that the fluid travels upon ejection from the fluid-ejection nozzles 204 until it reaches the media is desirably minimized to prevent degraded image-formation quality on the media, where the fluid is particularly ink. Therefore, the distance 420 that the housing 402 and/or the shutter 406 adds is substantially insufficient to result in such degraded image-formation quality. In one embodiment, for instance, the distance 420 may be 1.5 millimeters.

As particularly depicted in FIG. 4B, disposed on the underside of the shutter 406 is a capping material 410, which is more generally a capping mechanism of the service station 104. The capping material 410 maintains humidification of the fluid-ejection nozzles 204 of FIG. 2 when the nozzles 204 are not exposed through the slot 408 of the shutter 406, such as during periods of nonuse of the fluid-ejection device 100. The capping material 410 may be a closed-cell foam, an open-cell foam, an integral part of the material of the shutter, a thermosetting plastic, a thermoplastic, an elastomer, a composite thereof, or another type of material. In at least some embodiments, the capping material 410 is the material that wipes the fluid-ejection nozzles 204, via the wiping action of the shutter 406. Furthermore, in another embodiment, the capping material 410 may be omitted, and replaced by, for instance, a recessed or raised area within the shutter 406, or another feature. Thus, the wiping mechanism can be same mechanism as the capping mechanism.

Therefore, in one embodiment, the shutter 406 of the service station 104 defaults to the position depicted in FIG. 4A, in which the fluid-ejection nozzles 204 of FIG. 2 are not exposed through the slot 408. In this position of the shutter 406, the fluid-ejection nozzles 204 are capped by the capping material 410 on the underside of the shutter 406. That is, the capping material 410 is positioned incident to the fluid-ejection nozzles 204 in this position of the shutter 406. In this embodiment, it can be said that the shutter 406 is normally closed, in that the fluid-ejection nozzles 204 are normally not exposed through the slot 408 of the shutter 406.

However, in another embodiment, the shutter 406 of the service station 104 may be normally open, such that the shutter 406 defaults to the position at the other side of the opening 404 indicated by the reference number 418 in FIG. 4B. In this position of the shutter 406, the fluid-ejection nozzles 204 of FIG. 2 are exposed through the slot 408. That is, in this position of the shutter 406, the fluid-ejection nozzles 204 are not capped by the capping material 410 on the underside of the shutter 406.

In the embodiment of FIGS. 4A and 4B, movement of the shutter 406 within the opening 404 from the position depicted in FIGS. 4A and 4B to the position in which the shutter 406 is at the other side of the opening 404 indicated by the reference number 418 in FIG. 4B results in the shutter 406 wiping the fluid-ejection nozzles 204 of FIG. 2. Substantially any fluid, be it liquid or dried, on the fluid-ejection nozzles 204 and/or on the surface of the fluid-ejection mechanism 102 on which the nozzles 204 are disposed is wiped towards the end of the opening 404 of the housing 402 indicated by the reference number 418 in FIG. 4B. Therefore, by the shutter 406 moving within the opening 404 so that the fluid-ejection nozzles 204 become exposed through the slot 408 and are no longer capped by the capping material 410, the nozzles 204 are wiped.

Thus, the shutter 406 performs a service operation known as wiping, in which the fluid-ejection nozzles 204 are wiped to clear any liquid or dried fluid from the nozzles 204. Furthermore, a service operation known as spitting, in which fluid is ejected from the fluid-ejection nozzles 204 to assist in clearing clogs, may be performed while the nozzles 204 are positioned adjacent to the capping material 410. That is, the fluid output during such spitting is ejected from the fluid-ejection nozzles 204 onto the capping material 410. In such an embodiment, the capping material 410 therefore serves to maintain humidification of the fluid-ejection nozzles 204 when the nozzles 204 are capped, and may also act as a spittoon-to collect the fluid ejected from the fluid-ejection nozzles 204 during spitting. Humidification in this sense generally and non-restrictively means ensuring that the fluid-ejection nozzles 204 do not dry out when not in use.

It is noted that, as has been previously described, when the shutter 406 has wiped the fluid ejection nozzles 204 of FIG. 2 and exposed them through slot 408, the capping material 410 is located adjacent to the fluid ejection nozzles 204. Consequently, the nearby area in contact with and adjacent to the capping material 410 may become wetted with fluid. Over time, due to the evaporative process, the viscosity of the fluid may change making it undesirable to transfer this fluid back onto the nozzles 204 when the shutter returns to the first, default position. To minimize this issue, a hydrophobic (i.e., low surface energy) surface treatment may be applied to the adjacent area of the fluid-ejection mechanism 102. This treatment may include, but is not limited to: constructing the adjacent area of a hydrophobic material, applying a hydrophobic coating, applying a film, tape, label, or a combination thereof.

Movement of the shutter 406 within the opening 404 of the housing 402 is achieved in one embodiment as follows. A non-elastic flexible member 412, such as a flexible belt and which may be a polyimide film, or another type of material, attaches the shutter 406 to a mechanical actuator 414, such as a lever. Actuation of the mechanical actuator 414 pulls the non-elastic flexible member 412, causing the shutter 406 to move from the position depicted in FIGS. 4A and 4B to the position at the other end of the opening 404 of the housing 402 indicated by the reference number 418 in FIG. 4B. As described in greater detail below with reference to FIGS. 11A through 14, the mechanical actuator 414 may be actuated by a user, or under control of the fluid-ejection device 100 itself.

At the other side of the shutter 406 from the side at which the non-elastic flexible member 412 is attached to the shutter 406, a tension spring 416 is attached to the shutter 406. After the mechanical actuator 414 has been actuated so that the shutter 406 is moved to the position at the end of the opening 404 indicated by the reference number 418 in FIG. 4B, subsequent release of the mechanical actuator 414 results in the tension spring 416 pulling the shutter 406 back to the position depicted in FIGS. 4A and 4B. As has been described, in one embodiment this position of the shutter 406 may be the normally closed position in which the fluid-ejection nozzles 204 of FIG. 2 are capped by the capping material 410 during such periods of nonuse and are not exposed through the slot 408 of the shutter 406. It is noted that in other embodiments, the spring 416 and the non-elastic flexible member 412 may be omitted in lieu of one or more features that maintain the shutter 406 such that it is biased in one of the two positions that have been described until directly driven in either direction via other features.

The service station 104 that has been described remains mounted on the fluid-ejection mechanism 102 while the fluid-ejection mechanism 102 is used to eject fluid onto media. Before or after such fluid ejection, the fluid-ejection mechanism 102 can be serviced by the service station 104, such as by being wiped by the shutter 406, without having to dock the fluid-ejection device 100 at a docking station. That is, because the service station 104 remains mounted on the fluid-ejection mechanism 102 during usage of the fluid-ejection device 100, servicing of the mechanism 102 can substantially occur at any time, and the device 100 does not have to be moved to a separately located docking station for such servicing to occur.

Figure 5:
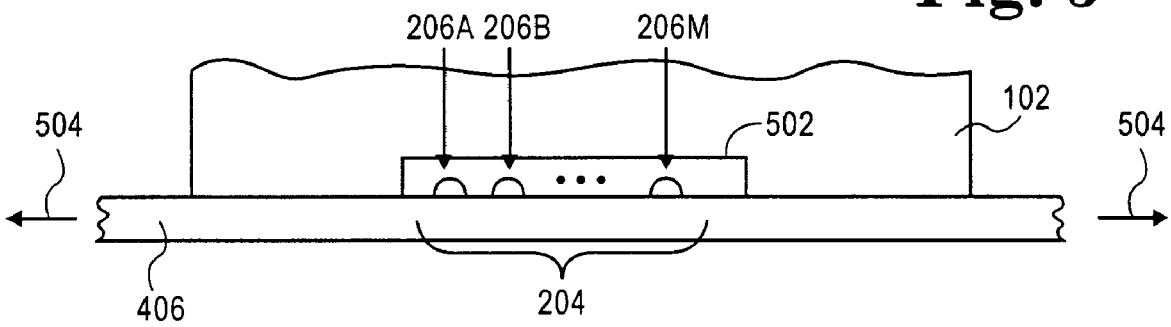
FIG. 5 is a diagram of how a shutter of a service station may move perpendicular to the columns over which the fluid-ejection nozzles of a fluid-ejection mechanism are organized, according to one embodiment.

FIG. 5 shows in more detail a side view of how the shutter 406 moves back and forth over the fluid-ejection nozzles 204 of the fluid-ejection mechanism 102 as has been described, according to an embodiment of the invention. The surface of the fluid-ejection mechanism 102 on which the fluid-ejection nozzles 204 are disposed is identified in FIG. 5 as an orifice plate, or die, 502. Just a portion of the fluid-ejection mechanism 102 is depicted in FIG. 5. The shutter 406 moves back and forth over the fluid-ejection nozzles 204, as indicated by the arrows 504. Just a portion of the shutter is depicted in FIG. 5, and the slot 408 and the wiping material 410 are not particularly shown in FIG. 5.

In this embodiment, the movement of the shutter 406 over the fluid-ejection nozzles 204 is perpendicular to the columns 206 over which the nozzles 204 are organized. Thus, fluid around the fluid-ejection nozzles 204 within the column 206B is moved past the nozzles within the column 206A when the shutter 406 is moved to the left. This is not problematic where the fluid-ejection nozzles 204 within each of the columns 206 eject the same type of fluid, such as the same color of ink. However, it may not be desirable where the fluid-ejection nozzles 204 within different columns eject different types of fluid, such as different colors of ink. For example, the fluid around the fluid-ejection nozzles 204 within the column 206B may be black ink, and the fluid around the nozzles 204 within the column 206A may be yellow ink, such that movement of the shutter 406 causes the black ink to be moved past the nozzles 204 within the column 206A, potentially contaminating these nozzles with black ink.

Figure 6:
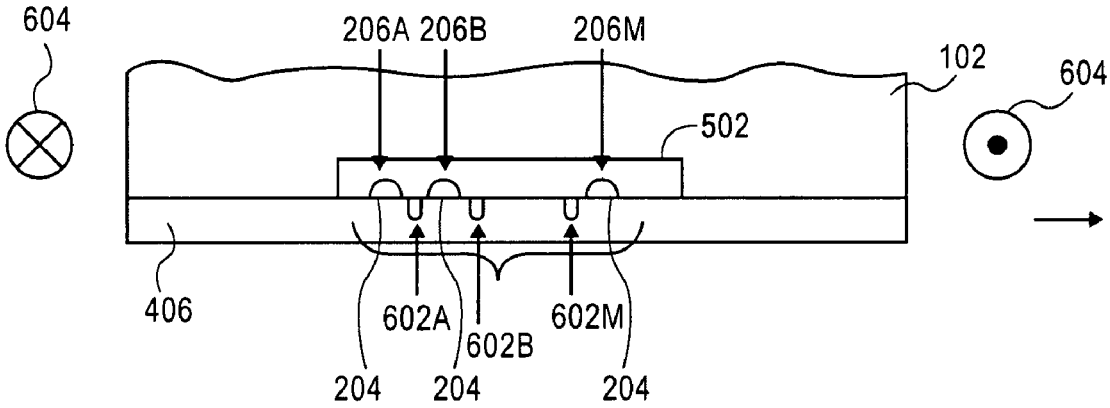
FIG. 6 is a diagram of how a shutter of a service station may alternatively move parallel to the columns over which the fluid-ejection nozzles of a fluid-ejection mechanism are organized, according to one embodiment.

Therefore, FIG. 6 shows in more detail a side view of how the shutter 406 can move back and forth over the fluid-ejection nozzles 204 of the fluid-ejection mechanism 102 to substantially avoid such potential contamination, according to an embodiment of the invention. The surface of the fluid-ejection mechanism 102 on which the fluid-ejection nozzles 204 are disposed is again identified as an orifice plate, or die, 502. As in FIG. 5, just a portion of the fluid-ejection mechanism 102 and just a portion of the shutter 406 are depicted in FIG. 6, and the slot 408 and the wiping material 410 are not particularly shown in FIG. 6.

However, unlike in FIG. 5, where the shutter 406 moves back and forth over the fluid-ejection nozzles 204 in a direction perpendicular to the columns 206 over which the nozzles 204 are organized, in FIG. 6 the shutter 406 moves back and forth over the fluid-ejection nozzles 204 in a direction parallel to the columns 206. That is, in FIG. 6, the shutter 406 moves into and out of the plane of FIG. 6, as indicated by the symbols identified by the reference number 604. Therefore, where the fluid-ejection nozzles 204 of different of the columns 206 eject different types of fluid, movement of the shutter 406 is less likely to cause fluidic cross-contamination among the nozzles 204 of different of the columns 206. In other words, the fluid-ejection nozzles 204 of the-fluid-ejection mechanism 102 are wiped such that each fluid-ejection nozzle remains substantially uncontaminated by fluid of a different type than that which it ejects.

In one embodiment, such fluidic cross-contamination among the fluid-ejection nozzles 204 of the fluid-ejection mechanism 102 is further inhibited by barriers 602A, 602B, . . . , 602M, collectively referred to as the barriers 602, within the shutter 406. The barriers 602 may be ribs, trenches, or other types of barriers. The barriers 602 separate adjacent columns 206 of the fluid-ejection nozzles 206, and thus run parallel to the columns 206 along the length of the shutter 406 into the plane of FIG. 6. The barriers 602 substantially prevent fluid migrating from one of the columns 206 to another of the columns 206 while the shutter 406 is moved back and forth over the fluid-ejection nozzles 204 perpendicular to the plane of FIG. 6.

Figure 7:
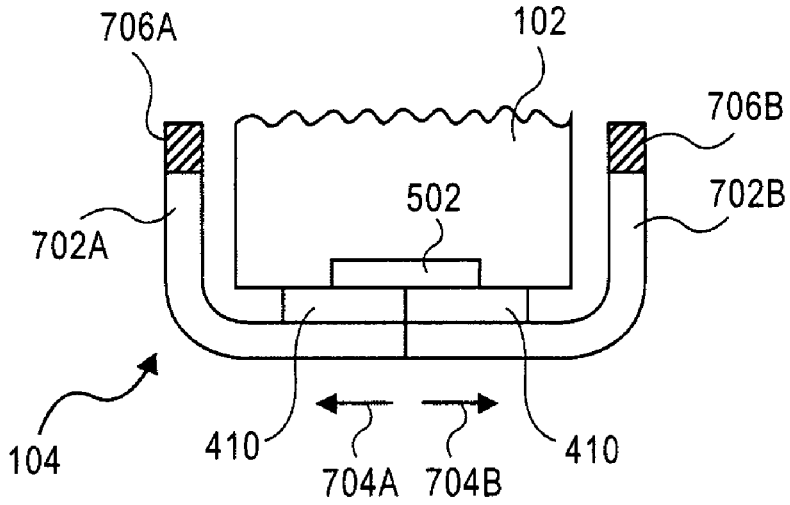
FIGS. 7, 8, 9, and 10 are diagrams of service stations for fluid-ejection mechanisms of handheld fluid-ejection devices, according to other embodiments.

FIG. 7 shows the service station 104 for the fluid-ejection mechanism 102 of the fluid-ejection device 100, according to another embodiment of the invention. The service station 104 includes two arms 702A and 702B, collectively referred to as the arms 702, and the capping material 410, which is divided between the arms 702. The capping material 410 is disposed between the arms 702 and the surface of the fluid-ejection mechanism 102 that includes the orifice plate 502 in which the fluid-ejection nozzles 204 of FIG. 2 are situated, although the nozzles 204 are not themselves depicted in FIG. 7.

In the closed position as shown in FIG. 7, the arms 702 are positioned over the orifice plate 502 of the fluid-ejection mechanism 102, such that the capping material 410 covers the orifice plate 502. Pinching the arms 702 at the locations 706A and 706B results in the arms 702 moving outwards from the fluid-ejection mechanism 102, as indicated by the arrows 704A and 704B, exposing the orifice plate 502 and hence the fluid-ejection nozzles 204 of FIG. 2. During movement of the arms 702, the arms 702, via the capping material 410, wipe the fluid-ejection nozzles 204 and the orifice plate 502.

The arms 702 can be said to be two portions of a wiping mechanism in the embodiment of FIG. 7. As such, the arms 702 are movable back and forth from the position depicted in FIG. 7 in which the arms 702 are mated with one another at their tips, to another position in which they are located away from one another. In this latter position, then, the fluid-ejection nozzles 204 of FIG. 2 are exposed, so that fluid ejection therefrom onto media can occur.

Figure 8:
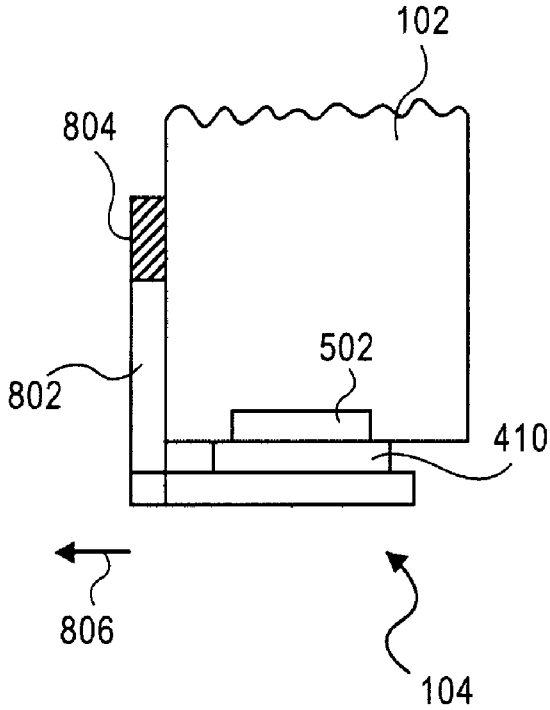

FIG. 8 shows the service station 104 for the fluid-ejection mechanism 102 of the fluid-ejection device 100, according to another embodiment of the invention. The service station 104 includes a cantilever 802 having a portion 804 that is mounted on the fluid-ejection mechanism 102, and the capping material 410. The cantilever 802 is flexibly rigid. In the closed position as shown in FIG. 8, the cantilever 802 is positioned over the orifice plate 502 on the face of the fluid-ejection mechanism 102. As before, the orifice plate includes the fluid-ejection nozzles 204 of FIG. 2, although the nozzles.204 are not themselves depicted in FIG. 8. In this position, the capping material 410 covers the orifice plate 502.

The cantilever 802 is movable so that it and the capping material 410 no longer cover the orifice plate 502 and the fluid-ejection nozzles 204 of FIG. 2, in the direction indicated by the arrow 806. During movement of the cantilever 802, the cantilever 802 via the capping material 410 wipes the fluid-ejection nozzles 204 and the orifice plate 502. The cantilever 802 remains attached to the fluid-ejection mechanism 102 at the portion 804 of the cantilever 802, such that the cantilever 802 flexibly bends to expose the orifice plate 502.

The cantilever 702 can be said to be a wiping mechanism in the embodiment of FIG. 8. As such, the cantilever 702 is movable back and forth from the position depicted in FIG. 8 in which the cantilever 702 covers the orifice plate 502, to another position in which the cantilever 702 no longer covers the portion of the face of the fluid-ejection mechanism 102 containing the orifice plate 502 and the fluid-ejection nozzles 204 of FIG. 2. In this latter position, the fluid-ejection nozzles 204 are exposed, so that fluid ejection therefrom onto media can occur.

Figure 9:
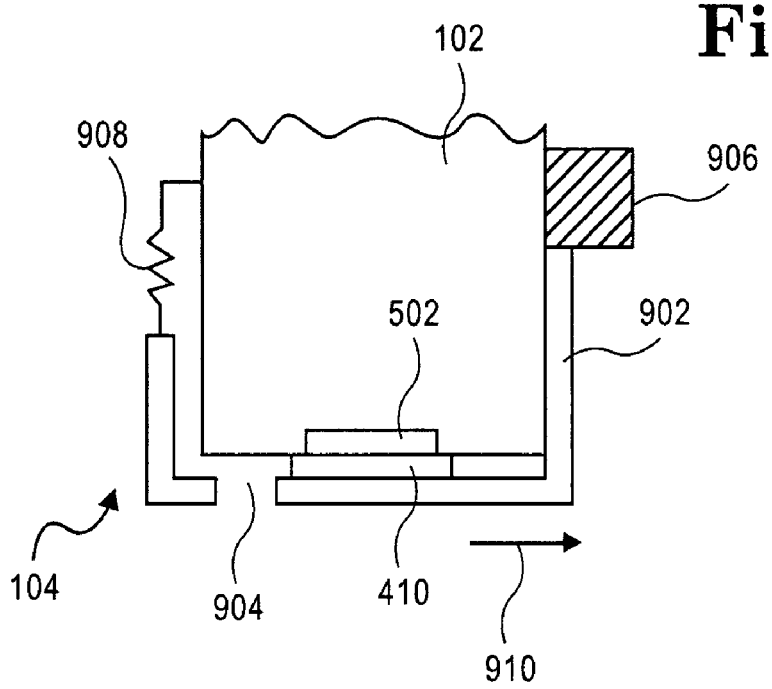

FIG. 9 shows the service station 104 for the fluid-ejection mechanism 102 of the fluid-ejection device 100, according to another embodiment of the invention. The service station 104 includes a non-elastic flexible member 902 defining a slot 904, and the capping material 410. In the closed position as shown in FIG. 9, the orifice plate 502, containing the fluid-ejection nozzles 204 of FIG. 2 that are not shown in FIG. 9, is not exposed. Rather, the capping material 410 covers the orifice plate 502.

The non-elastic flexible member 902 at one end is attached to a mechanical actuator 906, and at another end is attached to a tension spring 908. Moving the mechanical actuator 906 upwards causes the non-elastic flexible member 902 to move to the right, as indicated by the arrow 910. As such, the capping material 410 no longer covers the orifice plate 502 and the fluid-ejection nozzles 204 of FIG. 2, and the plate 502 and the nozzles 204 become exposed through the slot 904 within the non-elastic flexible member 902. During movement of the non-elastic flexible member 902, the non-elastic flexible member 902 via the capping material 410 wipes the fluid-ejection nozzles 204 and the orifice plate 502.

The non-elastic flexible member 902 can be said to be a wiping mechanism in the embodiment of FIG. 9. As such, the non-elastic flexible member 902 is movable back and forth from the position depicted in FIG. 9 in which the orifice plate 502 is covered by the capping material 410, to another position in which the orifice plate 502 is exposed through the slot 904. In this latter position, the fluid-ejection nozzles 204 of FIG. 2 are exposed, so that fluid ejection onto media can occur. Releasing the mechanical actuator 906 results in the spring 908 pulling the non-elastic flexible member 902 back to the position depicted in FIG. 9, in which the orifice plate 502 and the fluid-ejection nozzles 204 are not exposed.

Figure 10:
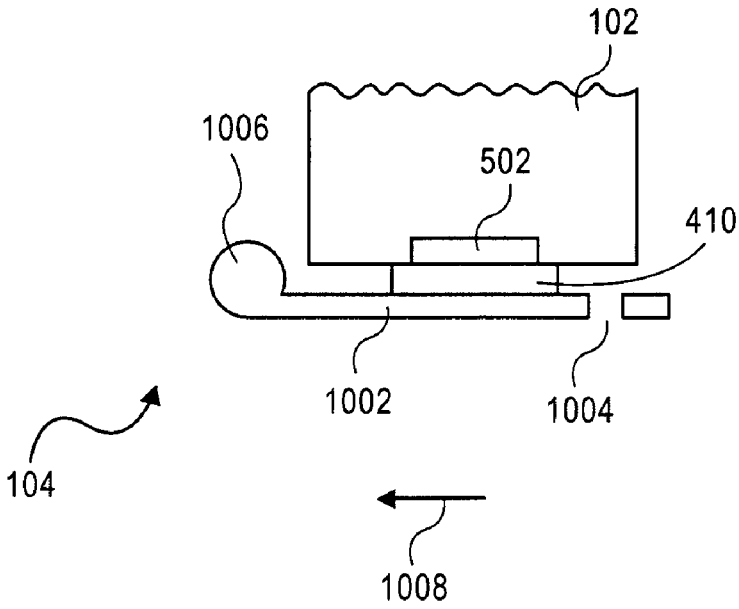

FIG. 10 shows the service station for the fluid-ejection mechanism 102 of the fluid-ejection device 100, according to another embodiment of the invention. The service station 104 includes a non-elastic flexible member 1002 defining a slot 1004, and the capping material 410. The non-elastic flexible member 1002 is again flexible. In the closed position as shown in FIG. 10, the orifice plate 502, containing the fluid-ejection nozzles 204 of FIG. 2 that are not shown in FIG. 10, is not exposed. Rather, the capping material 410 covers the orifice plate 502.

The non-elastic flexible member 1002 is rolled within a roll 1006. Winding the non-elastic flexible member 1002 within the roll 1006 causes the non-elastic flexible member 1002 to move to the left, as indicated by the arrow 1008. As such, the capping material 410 no longer covers the orifice plate 502 and the fluid-ejection nozzles 204 of FIG. 2, and the plate 502 and the nozzles 204 become exposed-through the slot 1004 within the non-elastic flexible member 1002. During movement of the non-elastic flexible member 1002, the non-elastic flexible member 1002 via the capping material 410 wipes the fluid-ejection nozzles 204 and the orifice plate 502.

The non-elastic flexible member 1002 likewise can be said to be a wiping mechanism in the embodiment of FIG. 10. As such, the non-elastic flexible member 1002 is movable back and forth from the position depicted in FIG. 10 in which the orifice plate is covered by the capping material 410, to another-position in which the orifice plate 502 is exposed through the slot 1004. In this latter position, the fluid-ejection nozzles 204 of FIG. 2 are exposed, so that fluid ejection onto media can occur. The non-elastic flexible member 1002 is unwound from the roll 1006 to move the non-elastic flexible member 1002 back to the position depicted in FIG. 10, in which the orifice plate 502 and the fluid-ejection nozzles 204 are not exposed.

Embodiments of a service station 104 for a fluid-ejection mechanism 102 of a handheld fluid-ejection device 100 have been presented herein that can remain mounted on the fluid-ejection mechanism 102 while the mechanism 102 is used to eject fluid onto media. Such a servicing station 104 generally includes a wiping mechanism and a capping mechanism. The wiping mechanism is that which moves back and forth over the fluid-ejection mechanism 102, to directly and/or indirectly wipe the fluid-ejection mechanism 102. The capping mechanism is that which caps the fluid-ejection mechanism 102 during periods of nonuse of the fluid-ejection device 100. The capping mechanism can also be that which actually contacts the fluid-ejection mechanism 102 during wiping by the wiping mechanism.

As described above, the handheld fluid-ejection device 100 may in one embodiment be a handheld inkjet-printing device that ejects ink to form an image on media. Specifically, a user holds the device 100 in his or her hand and moves the fluid ejection device 100 across the media while the device 100 is ejecting fluid on the media to form an image. In some applications, such as some industrial printing applications, servicing requirements for the fluid-ejection mechanism 102 are much more rigorous compared to consumer applications. By way of example only, in some applications a specialized fast-drying ink is required so that fluid-ejection device 100 can be used to form an image (e.g., a label) on a moving article with the inked-surface drying shortly after being applied and before contacting a secondary surface (such as another package) to avoid smearing. In some applications, fluid-ejection device 100 is exposed to aggressive environments with respect to temperature and humidity. In some applications, such as during high use periods, there is very little time for extended servicing of fluid-ejection device 100 in general and fluid-ejection mechanism 102 in particular. In order to maintain proper functioning of fluid-ejection nozzles 204, conditions such as fast-drying ink, aggressive temperature and humidity, and limited time for extended servicing all require increased servicing frequency of fluid-ejection mechanism 102 as compared to a desk top printer. Further, fluid-ejection device 100 has power, size and weight constraints that do not normally have to be addressed for the service station of a desk top printer. Any one or more of these servicing constraints, in addition to other servicing constraints not specifically mentioned, may be present.

Referring to FIGS. 1A and 1B, one embodiment of the fluid-ejection device 100 is a swipe-type device that utilizes a rotary encoder driven by an encoder wheel 1102 projecting above the front surface of the device 100 indicated by the arrow 116. Printing is accomplished by the fluid-ejection mechanism 102 through a print aperture 1108 (aligned with the nozzles 204) in the cover 108. An idler wheel 1110 projecting above the surface indicated by arrow 116 is positioned at an opposite side of the aperture 1108 from the encoder wheel 1102. As described above with reference to FIGS. 4A and 4B, the shutter 406 of the service station 104 is closed during periods of non-use of the fluid-ejection device 100. In the closed position, the wiping mechanism and capping mechanism of the service station 104 keep the die 502 of the fluid-ejection mechanism 102 humidified and protected. The shutter 406 of the service station 104 is moved between the open and closed positions via the mechanical actuator 414 which may be actuated by a user, or under control of the fluid-ejection device 100 itself.

Figure 11A:
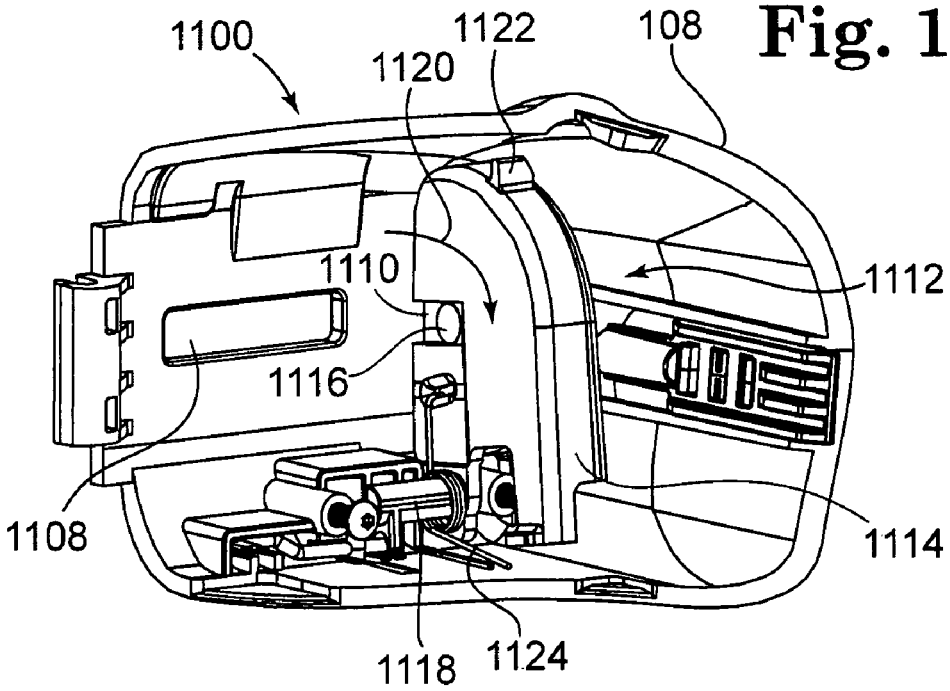
FIGS. 11A and 11B are diagrams of an apparatus for manually actuating a service station according to one embodiment.
Figure 11B:
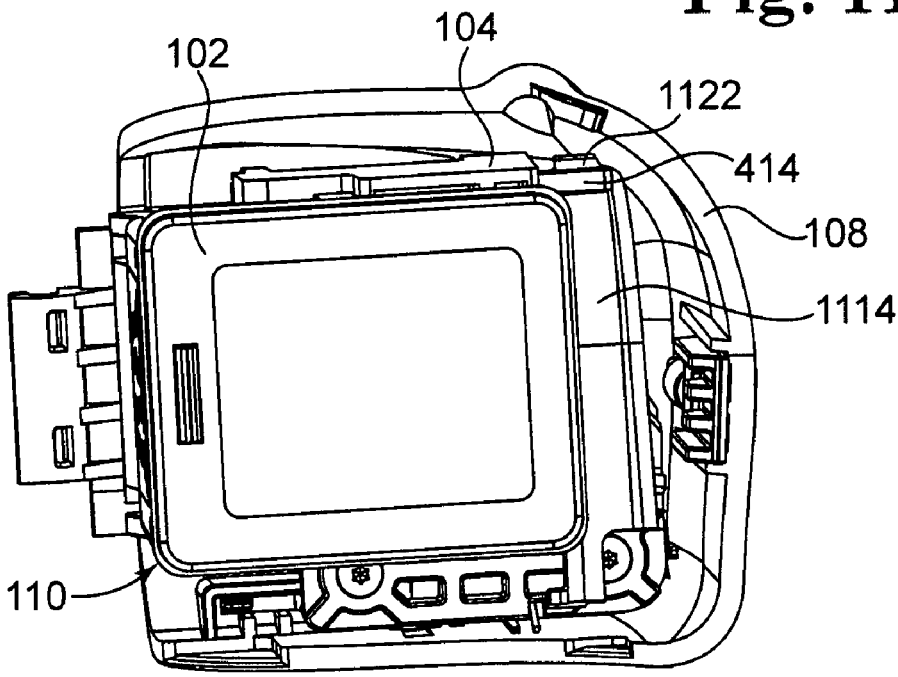

FIGS. 11A and 11B illustrate one embodiment of a manual actuation mechanism 1100 for actuating the -service station 104 and moving the shutter 406 between the open and closed positions to service the fluid ejection mechanism 102. FIG. 11A illustrates the manual actuation mechanism 1100 in the interior of the access door or cover 108 of the fluid-ejection device 100, while FIG. 11B illustrates the fluid-ejection assembly 110 (e.g., the fluid-ejection mechanism 102 and the service station 104) as correctly positioned with respect to the manual actuation mechanism 1100 when the cover 108 is closed (as shown in FIG. 1B). For purpose of clarity, the remainder of device 100 is not shown in FIG. 11B Referring to FIG. 11A, idler wheel 1110 is part of an idler wheel assembly 1112. The idler wheel assembly 1112 includes an idler wheel housing 1114. The idler wheel 1110 is mounted within the idler wheel housing 1114 on a shaft 1116, such that the idler wheel 1110 may rotate about the shaft 1116. The idler wheel housing 1114, with idler wheel 1110 rotatably secured therein, is pivotally mounted within the cover 108 by a shaft assembly 1118, such that the idler wheel 1110 moves inwardly when the portion of the idler wheel 1102 projecting above the exterior surface indicated by the arrow 116 (FIG. 1B) is pressed against a surface, such as a surface to be printed on. Specifically, the idler wheel housing 1114 may rotate in the direction of arrow 1120 when the idler wheel 1102 is pressed against a surface to be printed on. As best seen in FIG. 11B, the idler wheel housing 1114 includes a protrusion 1122 positioned and shaped to engage the mechanical actuator 414 of the service station 104 when the idler wheel housing 1114 rotates in the direction of the arrow 1120. A bias spring 1124 urges the idler wheel housing 1114 and the idler wheel 1110 therein in the opposite direction of the arrow 1120 and returns it to the starting position when device 100 is moved away from the surface to be printed on.

To initiate printing using the fluid-ejection device 100, the user places the front surface of the fluid ejection device 100 (indicated by arrow 116 in FIG. 1B) against a surface to be printed on, thereby pushing the idler wheel 1110 into the housing 106 and causing the idler wheel housing 1114 to rotate inward about shaft assembly 1118 (e.g., in the direction of arrow 1120). When the idler wheel assembly 1118 rotates inward, protrusion 1122 on the housing 1114 engages and displaces mechanical actuator 414 of the service station 104 and thereby actuates the shutter 406 (i.e., moves the shutter 406 from the closed position to the open position) to prepare for printing. When the fluid-ejection device 100 is moved away from the surface to be printed on, the bias spring 1124 urges the idler wheel housing 1114 in the direction opposite the arrow 1120, and the spring 416 pulls the shutter 406 back to the closed position. In this manner, the service station 104 is actuated every time printing is initiated, and the force for moving the mechanical actuator 414 is supplied by the user as part of the natural printing motion, thereby providing a method of operating the service station 104 in which no electromechanical drive, battery power or servicing logic is required.

The apparatus and method described above for manually actuating the service station 104 is simple, compact and power efficient. However, since the actuation force is generated by the user pressing the fluid-ejection device 100 against the surface to be printed on, applications with a compliant or soft surface to be printed on may require an actuation force independent of the force between the fluid-ejection device 100 and the surface to be printed on.

Figure 12A:
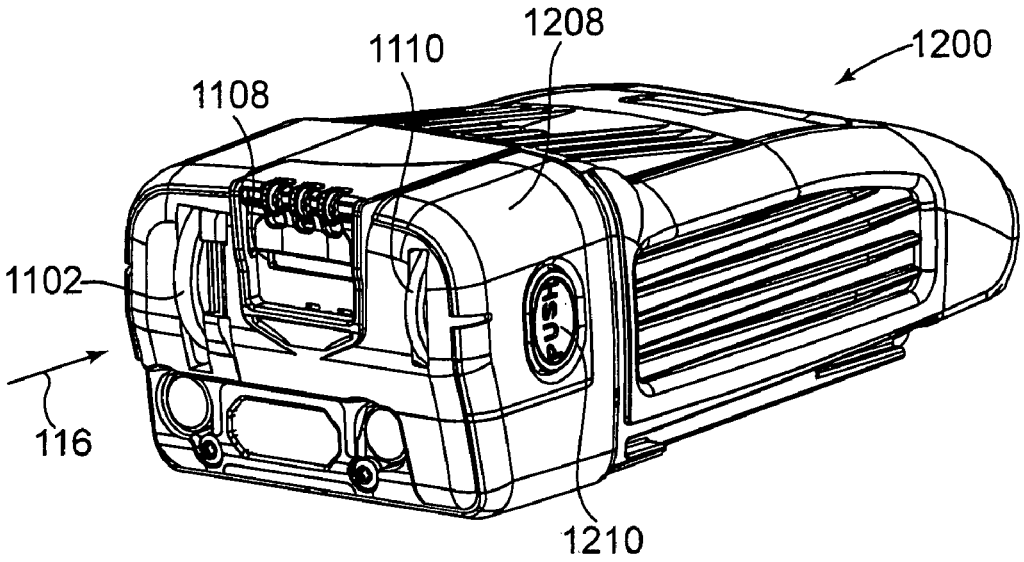
FIGS. 12A and 12B are diagrams of a representative handheld fluid-ejection device, according to another embodiment.
Figure 12B:
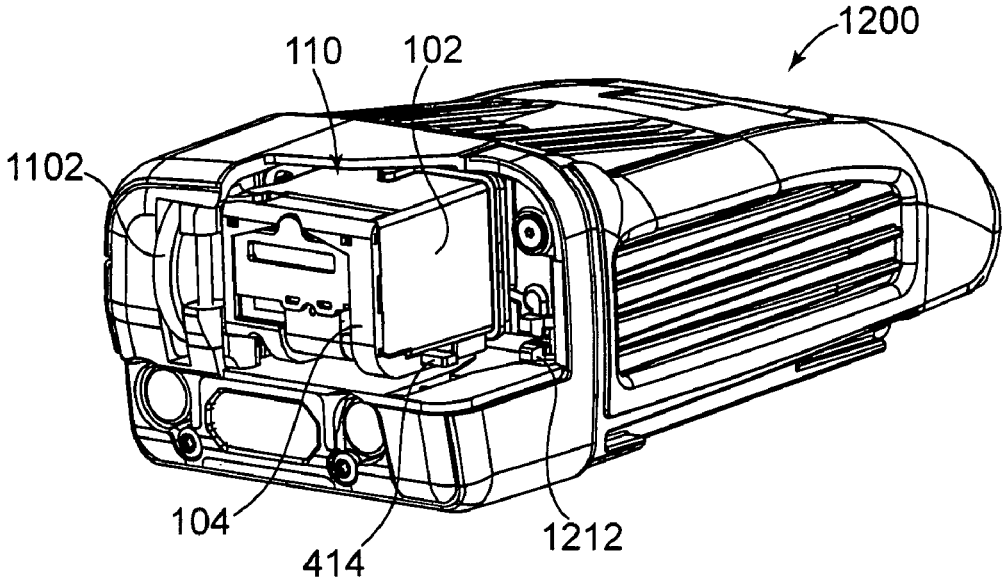

FIGS. 12A and 12B illustrate one embodiment of a fluid-ejection device 1200 in which the service station 104 is automatically actuated (e.g., the actuation force is not provided by the user). Except where specifically noted herein, fluid-ejection device 1200 includes components similar or identical to those describe with respect to fluid-ejection device 100. For example, fluid-ejection device 1200 may include components 112, and supplies of fluid 114, 115 as described with respect to fluid-ejection device 100. As with the fluid-ejection device 100, the fluid-ejection device 1200 is a swipe-type device that utilizes a rotary encoder driven by an encoder wheel 1102 projecting above the front surface of the device 1200 indicated by the arrow 116. The fluid-ejection device 1200 utilizes the fluid-ejection assembly 110 as described above, and printing is accomplished by the fluid-ejection mechanism 102 through a print aperture 1108 in the access door or cover 1208. The fluid-ejection device 1.200 further includes an idler wheel 1110. In the fluid-ejection device 1200, the position of the idler wheel 1110 is fixed with respect to the front surface of the device 1200, e.g. the idler wheel 1110 does not displace or rotate inward as described above with respect to the fluid ejection device 100. Idler wheel 1110 simply rotates to provide a second support point having similar friction characteristics with respect to encoder wheel 1102 during printing with device 1200. FIG. 12B illustrates fluid-ejection device 1200 with the cover 1.208 removed.

Printing with the fluid ejection-device 1200 is initiated in a manner similar to that described above with respect to the fluid-ejection device 100, except the force to actuate the service station 104 is not provided by displacing the idler wheel 1110. Consequently, the fluid-ejection device 1200 is suitable for printing on a wider range of printing surfaces than the fluid-ejection device 100 (i.e., soft and/or compliant surfaces).

Figure 13:
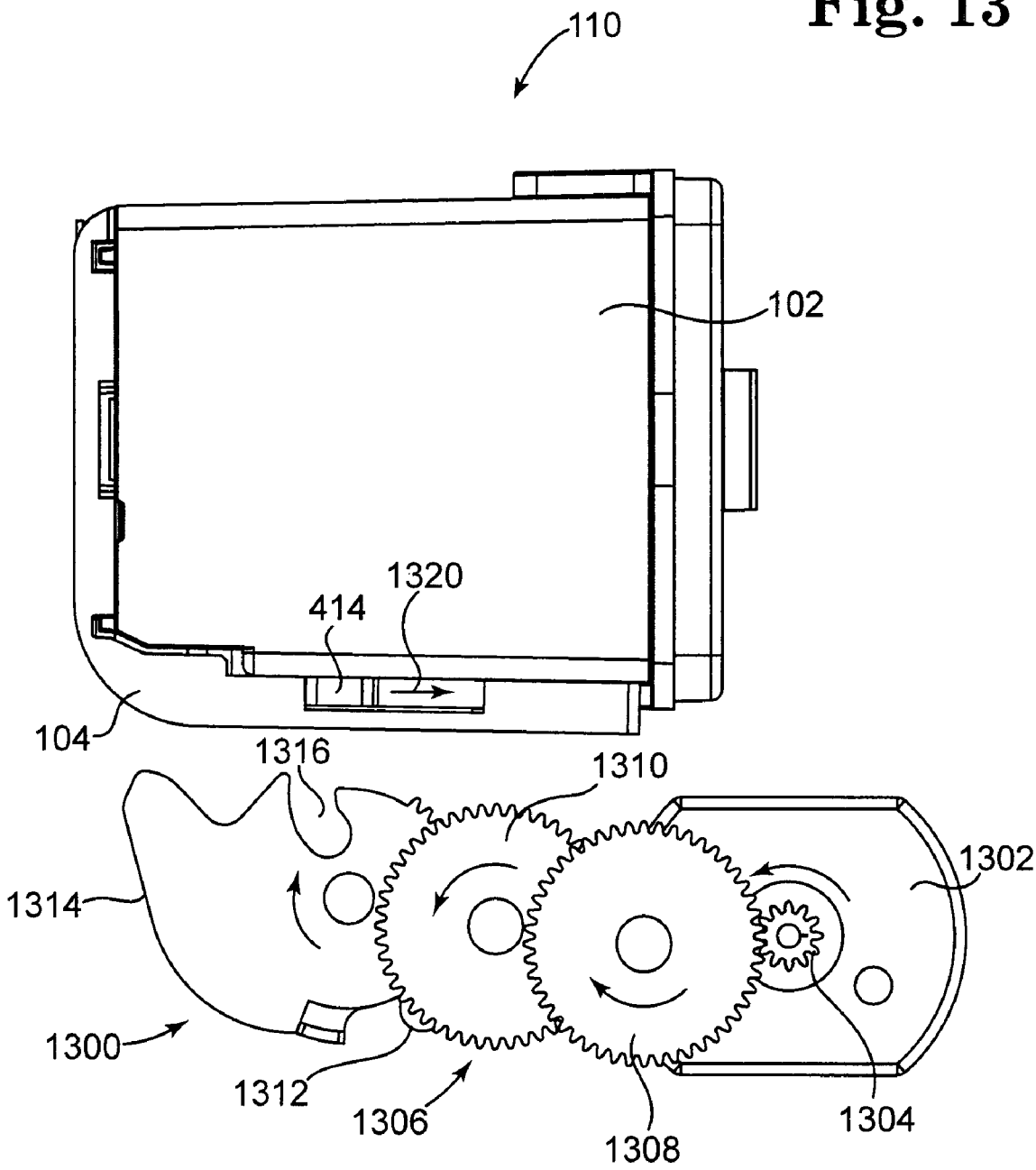
FIG. 13 is a diagram of one embodiment of an automatic actuation mechanism for the fluid-ejection device of FIGS. 12A and 12B.

FIG. 13 illustrates one embodiment of an automatic actuation mechanism 1300 for fluid-ejection device 1200. For purposes of clarity, only the automatic actuation mechanism 1300 and the fluid ejection assembly 110 (e.g., the fluid-ejection mechanism 102 and the service station 104) are illustrated. When printing is desired, the automatic actuation mechanism 1300 is activated such as by the user pressing a button 1210 on fluid-ejection device 1200 (FIG. 12A). In one embodiment, electric drive motor 1302 with a pinion gear 1304 drives a gear train 1306. In the illustrated embodiment, the pinion gear 1304 engages a first duplex gear 1308, which in turn drives a second duplex gear 1310 with a locking post 1312, which in turn drives a combination gear/cam 1314 with a corresponding locking female groove 1316. As the cam/ gear 1314 rotates, it engages the mechanical actuator 414 and moves actuator 414 in the direction of arrow 1320, thereby moving the shutter 406 of the service station 104 to the open position. In one embodiment, as the cam/gear 1314 rotates, the locking post 1312 engages the locking female groove 1316 such that when the cam/gear 1314 reaches the position where the shutter 406 is in the open position, the automatic actuation mechanism 1300 is self-locking. A self-locking feature allows power conservation, since the drive motor 1302 can be de-energized until the automatic actuation mechanism 1300 is again activated to reverse and close the shutter 406. FIG. 13 illustrates an exemplary means for self-locking the automatic actuation mechanism 1300.

Figure 14:
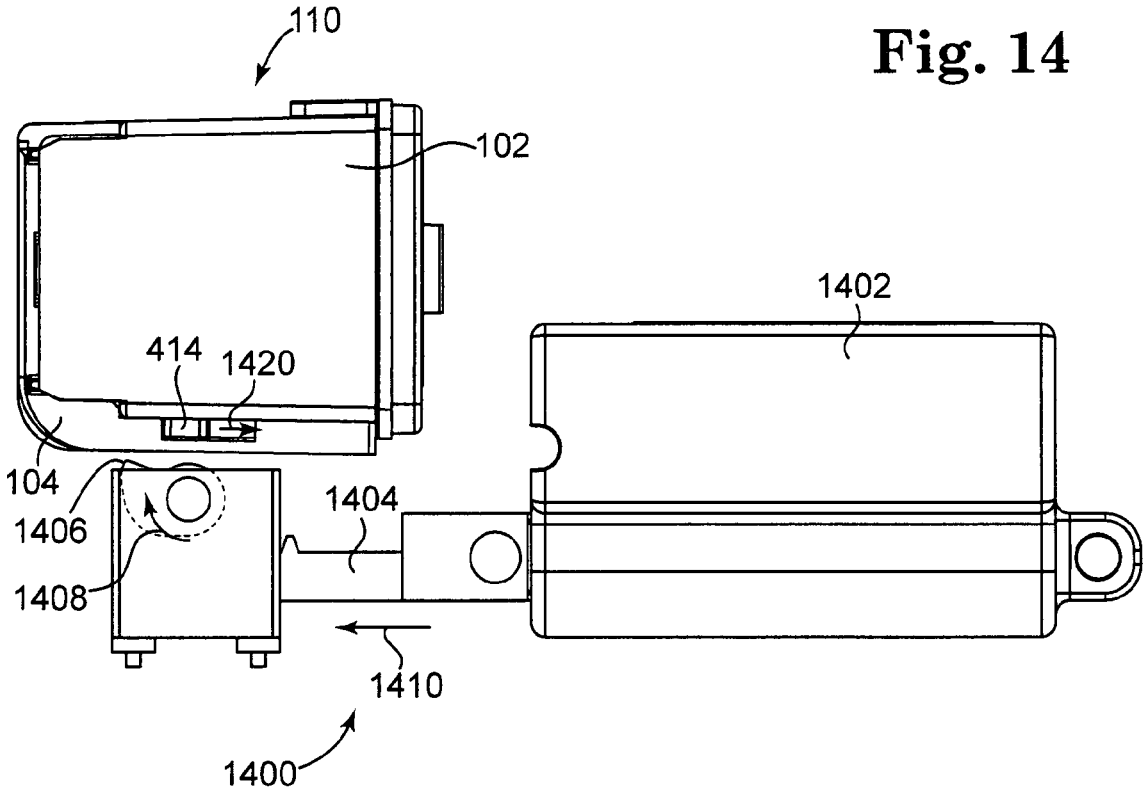
FIG. 14 is a diagram of another embodiment of an automatic actuation mechanism for the fluid-ejection device of FIGS. 12A and 12B.

FIG. 14 illustrates another embodiment of an automatic actuation mechanism 1400 for fluid-ejection device 1200. For purposes of clarity, only the automatic actuation mechanism 1400 and the fluid ejection assembly 110 (e.g., the fluid-ejection mechanism 102 and the service station 104) are illustrated. When printing is desired, the automatic actuation mechanism 1400 is activated such as by the user pressing a button 1210 on fluid-ejection device 1200 (FIG. 12A). Automatic actuation mechanism 1400 uses linear motion converted to rotary motion that actuates the shutter mechanism on the cartridge. As illustrated, a linear actuator 1402 as known in the art drives a rack gear/arm 1404 that rotates a combination gear/cam 1406 in the direction of arrow 1408 as the arm 1404 extends in the direction of arrow 1410. As gear/cam 1406 rotates in the direction of arrow 1408, gear/cam 1406 engages the mechanical actuator 414 of service station 104 and moves actuator 414 in the direction of arrow 1420, thereby moving the shutter 406 of the service station 104 to the open position. In one embodiment, as is known in the art, linear actuator 1402 includes an electric drive motor, gear reduction unit and ball screw drive to move rack gear/arm 1404. In one embodiment, linear actuator 1402 is self-locking to allow linear actuator 1402 to be de-energized until the automatic actuation mechanism 1400 is again activated to reverse and close the shutter 406. In one embodiment, the self-locking feature may be provided by a sufficiently large gear reduction within the linear actuator 1402 itself. FIG. 14 thereby illustrates an exemplary means for self-locking the automatic actuation mechanism 1400. In one embodiment, linear actuator 1402 employs a potentiometer to provide position feedback.

In the fluid-ejection device 1200, using either of the automatic actuation mechanisms 1300, 1400, if the automatic actuation mechanism 1300, 1400 is maintaining the shutter 406 in the open position, the fluid-ejection assembly 110 cannot be removed from the device 1200. Accordingly, in one embodiment, a door sensor 1212 (FIG. 12B) is provided to reverse the automatic actuation mechanisms 1300, 1400 and close the shutter 406 if the cover 1208 is opened or removed.

In one embodiment, activation of the automatic actuation mechanisms 1300, 1400 to reverse and close the shutter 406 is initiated by the user, such as by pressing the button 1210. In another embodiment, activation of the automatic actuation mechanisms 1300, 1400 to reverse and close the shutter 406 is initiated by a service station algorithm.

Figure 15:
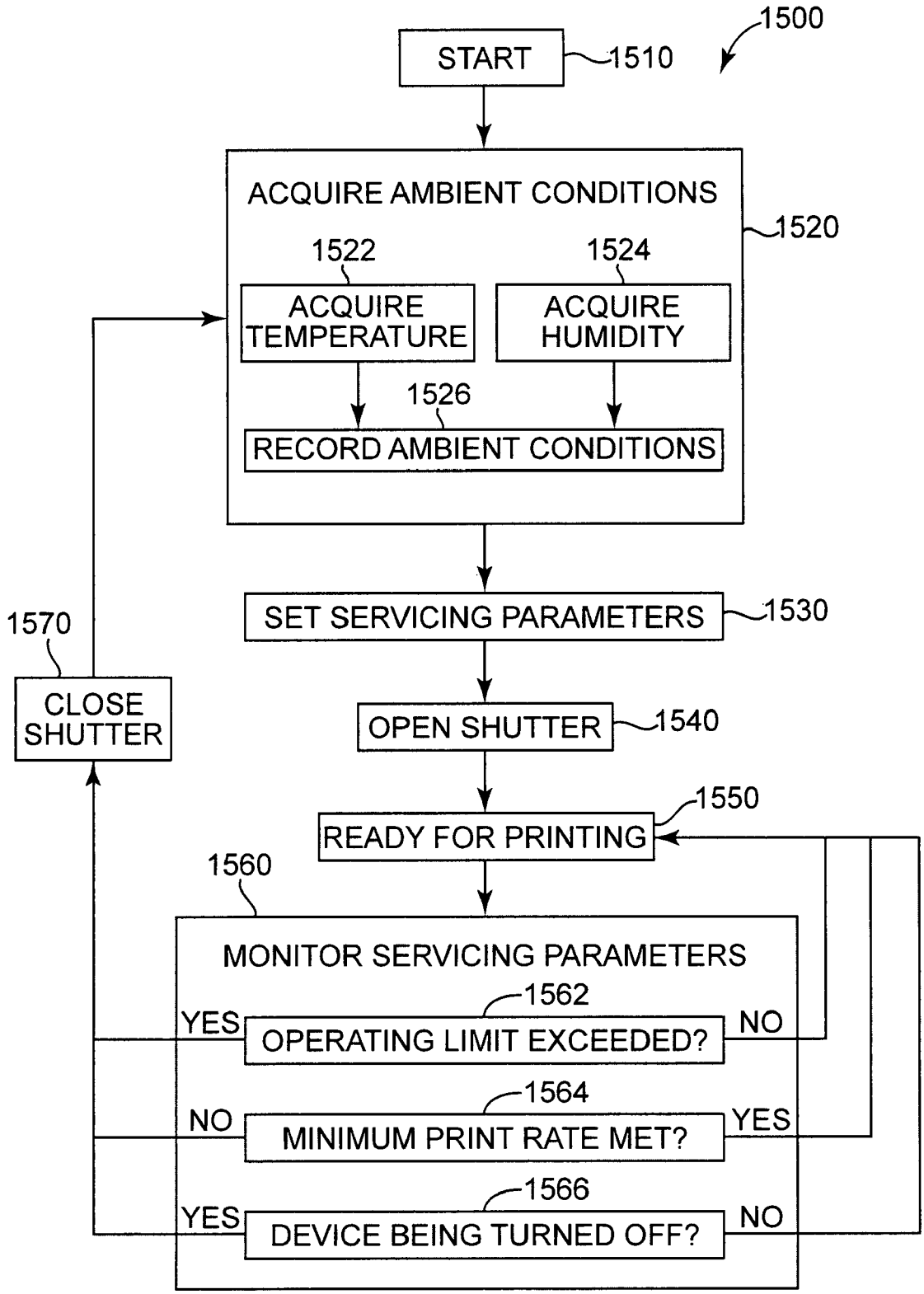
FIG. 15 is a flowchart illustrating one embodiment of a method for operating a service station of a fluid-ejection device.

FIG. 15 is a flowchart illustrating one embodiment of a method 1500 for operating the service station 104. Method 1500 adapts the routine of the service station 104 to changing environmental conditions, such as ambient temperature and humidity. Method 1500 is executed by one or more of components 112, such as semiconductor integrated circuits and memory devices.

At 1510, method 1500 is started, such by the user powering on fluid ejection-device 1200, or by initially activating the automatic actuation mechanism 1300, 1400.

At 1520, the ambient environmental conditions are acquired. At 1522, the ambient temperature is acquired. In one embodiment, the ambient temperature is acquired from a thermal sense resistor (TSR)103 (FIG. 1C) located on the die 502 of the fluid-ejection mechanism 102. Acquiring temperature data from the TSR advantageously utilizes a pre-existing capability present in many ink jet print heads. Further, the TSR is replaced with each new fluid-ejection mechanism 102. In another embodiment, a thermal sensor is located in the fluid-ejection device 1200, separate from the fluid-ejection mechanism 102. For example, one of components 112 may be a thermal sensor. In yet another embodiment, a thermal sensor (represented by sensor 101 in FIG. 1C) is remotely located from the fluid-ejection mechanism 1200, and the temperature data is supplied to the fluid-ejection mechanism 1200, i.e., by a wireless communication system. Similarly, in one embodiment, at 1524 the ambient humidity is acquired to further refine the operation of the service station 104. In one embodiment, a humidity sensor is located in the fluid-ejection device 1200. For example, one of components 112 may be a humidity sensor. In yet another embodiment, a humidity sensor (represented by densor 101 in FIG. 1C) is remotely located from the fluid-ejection mechanism 1200, and the humidity data is supplied to the fluid-ejection mechanism 1200, i.e., by a wireless communication system. At 1526, the acquired ambient environmental conditions are optionally recorded.

At 1530, the servicing parameters are set using the acquired ambient environmental conditions. In one embodiment, servicing parameters are set using a look-up table stored on one or more of components 112. Exemplary servicing parameters that may be set include, but are not limited to: the operating time limit; the minimum print rate; the block warming temperature; spit bars/areas in the printed area; spitting in the air just prior to printing; and white space fly spitting.

When a printing cycle is commenced, the service station shutter 406 is opened at 1540 and the device is ready for printing at 1550.

At 1560, monitoring of servicing parameters that were set at 1530 is initiated. In one exemplary embodiment, monitored service parameters include operating time, minimum print rate, and whether the fluid-ejection device 1200 has been turned off by the user. At 1562, the operating time is measured. If the operating time limit has been reached, then the shutter 406 is closed at 1570 and the process is restarted. At 1564, if the minimum print rate over time is not being met, then the shutter 406 is closed at 1570 and the process is restarted. Lastly, at 1566, if the fluid-ejection device 1200 has been turned off, then the shutter 406 is closed at 1570 and the process is restarted. In the exemplary embodiment, if the operating time limit has not been reached, the minimum print rate over time is being met, and the fluid-ejection device 1200 has not been turned off, device 1200 remains ready for printing.

Figure 16A:
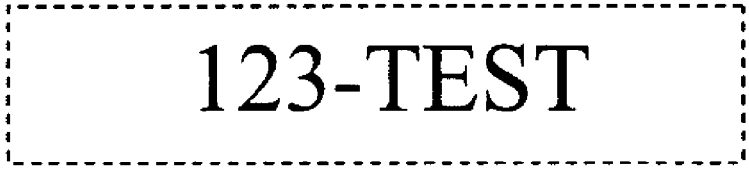
FIGS. 16A, 16B and 16C are diagrams of exemplary spitting routines.
Figure 16B:
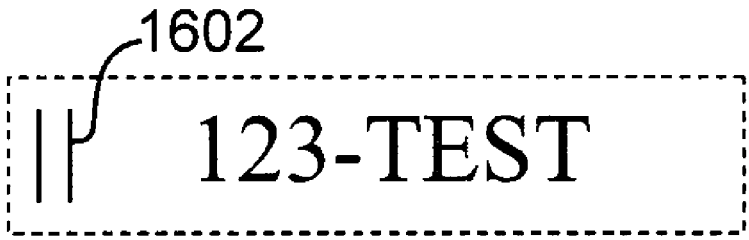
Figure 16C:
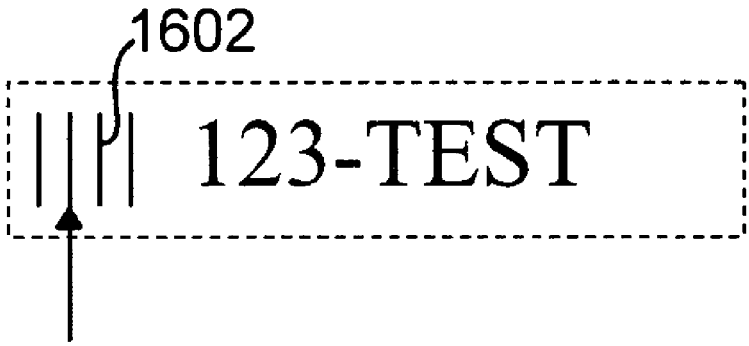

Depending on the ambient environmental conditions, it may be beneficial to the health of nozzles 204 to spit the nozzles 204. FIGS. 16A-16C illustrate three labels (having boundaries represented by the dashed lines) with simplified examples for spitting routines that can be implemented with the method of FIG. 15 (showing no spitting, intermediate spitting, and maximum spitting, respectively). Based on the servicing parameters set at 1530, varying amounts of nozzle spitting are conducted in an area of the image (i.e., a label) that is not being used. In the example of FIGS. 16A-16C, spitting is done in the form of closely spaced vertical blocks or lines 1602. In other embodiments, but virtually any spitting pattern can be employed in open areas of the printed image. In another embodiment, fly spitting is done in open areas of the printed image, either alone or in combination with higher density visible spit bars 1602. Fly spitting is the process of spitting at very low densities in open areas so that the ink is not really visible on the image. In many applications, and particularly in industrial applications, the presence of spit bars 1602 or fly spitting is not detrimental to the use or function of the printed image.

Embodiments of an apparatus for operating a service station 104 for a fluid-ejection mechanism 102 and methods for operating the service station 104 have been presented herein. While described herein with respect to a handheld fluid-ejection device 100, 1200, in which the fluid-ejection mechanism 102 is moved past the print media, the apparatus and methods of operating thereof are also beneficially employed with other printers, including printers where the fluid ejection mechanism 102 remains stationary and the print media is moved past the fluid ejection mechanism 102. The apparatus and methods for operation therof are robust, able to print in a wide variety of environments, compact and power efficient. The servicing methods presented enable these capabilities without requiring intervention from the user.

We claim:

1. A service station for use with a fluid ejection device having a fluid-ejection mechanism with at least one fluid-ejection nozzle, the service station comprising:

a housing configured to attach to the fluid-ejection mechanism and to remain attached to the fluid-ejection mechanism during the fluid-ejection operation;

a shutter arranged within the housing and including at least one opening, wherein the shutter is selectively moveable between a closed position and an open position with respect to the fluid-ejection nozzle, such that in the open position the opening exposes the fluid-ejection nozzle and in the closed position the fluid-ejection nozzle is covered; and an actuation mechanism separate from the housing and positioned to selectively couple with the shutter, such that activation of the actuation mechanism causes the shutter to move between the open and closed positions, wherein the actuation mechanism is a manual actuation mechanism, wherein a portion of the manual actuation mechanism projects from a surface of the fluid-ejection device, and wherein pressing the projecting portion of the manual actuation mechanism against a surface to be printed on moves the projecting portion to activate the manual activation mechanism.

2. The service station of claim 1, further comprising:

a mechanical actuator arranged within the housing and attached to the shutter such that displacement of the mechanical actuator causes the shutter to move between the open and closed positions; and wherein the actuation mechanism is selectively coupled to the mechanical actuator such that activation of the actuation mechanism causes displacement of the mechanical actuator.

3. The service station of claim 1, wherein the manual actuation mechanism comprises an idler wheel assembly having an idler wheel projecting from the surface of the fluid ejection device.

4. A service station for use with a fluid ejection device having a fluid-ejection mechanism with at least one fluid-ejection nozzle, the service station comprising:

a housing configured to attach to the fluid-ejection mechanism and to remain attached to the fluid-ejection mechanism during the fluid-ejection operation;

a shutter arranged within the housing and including at least one opening, wherein the shutter is selectively moveable between a closed position and an open position with respect to the fluid-ejection nozzle, such that in the open position the opening exposes the fluid-ejection nozzle and in the closed position the fluid-ejection nozzle is covered; and an actuation mechanism separate from the housing and positioned to selectively couple with the shutter, such that activation of the actuation mechanism causes the shutter to move between the open and closed positions, wherein the actuation mechanism is an automatic actuation mechanism, and further comprising a sensor configured to sense an open condition of an access door of the fluid ejection device, wherein the sensor signals the automatic actuation mechanism to move the shutter to the closed position when an open condition of the access door is sensed.

5. The service station of claim 4 wherein the automatic actuation mechanism comprises an electric motor moving the shutter between the open and closed positions.

6. The service station of claim 5, wherein the electric motor drives a rotary gear train that moves the shutter between the open and closed positions.

7. The service station of claim 5, wherein the electric motor drives a linear actuator that moves the shutter between the open and closed positions.

8. The service station of claim 5, further comprising means for self-locking the automatic actuation mechanism when the electric motor is not energized.

9. The service station of claim 4, wherein the automatic actuation mechanism is activated by the user.

10. The service station of claim 4, wherein the automatic actuation mechanism is activated by a service station algorithm.

11. The service station of claim 10, wherein the service station algorithm activates the automatic actuation mechanism based on ambient environmental conditions.

12. A service station for use with a fluid ejection device having a fluid-ejection mechanism with at least one fluid-ejection nozzle, the service station comprising:

a housing configured to attach to the fluid-ejection mechanism and to remain attached to the fluid-ejection mechanism during the fluid-ejection operation;

a shutter arranged within the housing and including at least one opening, wherein the shutter is selectively moveable between a closed position and an open position with respect to the fluid-ejection nozzle, such that in the open position the opening exposes the fluid-ejection nozzle and in the closed position the fluid-ejection nozzle is covered; and an actuation mechanism separate from the housing and positioned to selectively couple with the shutter, such that activation of the actuation mechanism causes the shutter to move between the open and closed positions, wherein the fluid-ejection mechanism comprises a plurality of fluid-ejection nozzles ejecting different types of fluid, and wherein movement of the shutter between the open and closed positions wipes the fluid-ejection mechanism such that each fluid-ejection nozzle remains substantially uncontaminated by fluid of a different type than that which the fluid-ejection nozzles eject.

13. The service station of claim 12, wherein the actuation mechanism is a manual actuation mechanism, wherein a portion of the manual actuation mechanism projects from a surface of the fluid-ejection device, and wherein pressing the projecting portion of the manual actuation mechanism against a surface to be printed on moves the projecting portion to activate the manual activation mechanism.

14. The service station of claim 13, wherein the manual actuation mechanism comprises an idler wheel assembly having an idler wheel projecting from the surface of the fluid ejection device.

15. The service station of claim 12, wherein the actuation mechanism is an automatic actuation mechanism, and further comprising a sensor configured to sense an open condition of an access door of the fluid ejection device, wherein the sensor signals the automatic actuation mechanism to move the shutter to the closed position when an open condition of the access door is sensed.

16. The service station of claim 15, wherein the automatic actuation mechanism is activated by the user.

17. The service station of claim 15, wherein the automatic actuation mechanism is activated by a service station algorithm.

18. The service station of claim 17, wherein the service station algorithm activates the automatic actuation mechanism based on ambient environmental conditions.

19. A method for operating a service station of a fluid ejection device having a fluid-ejection mechanism with at least one fluid-ejection nozzle, the method comprising:

acquiring ambient environmental conditions surrounding the fluid ejection device;

setting servicing parameters of the service station based upon the acquired ambient environmental conditions;

monitoring the set service parameters; and automatically operating the service station based on the monitored service parameters, wherein automatically operating the service station based on the monitored service parameters comprises closing a shutter of the service station when an operating time limit is reached, a minimum print rate is not met, or the fluid-ejection device is turned off.

20. The method of claim 19, wherein acquiring ambient environmental conditions surrounding the fluid ejection device comprises acquiring at least one of temperature and humidity.

21. The method of claim 19, wherein acquiring ambient environmental conditions surrounding the fluid ejection device comprises acquiring ambient environmental conditions using a sensor located in the fluid ejection device.

22. The method of claim 21, wherein acquiring ambient environmental conditions using a sensor located in the fluid ejection device comprises determining temperature using a thermal sense resistor in the fluid ejection mechanism.

23. The method of claim 19, wherein acquiring ambient environmental conditions surrounding the fluid ejection device comprises acquiring ambient environmental conditions using a sensor located remotely from the fluid ejection device.

24. The method of claim 19, wherein setting servicing parameters of the service station comprises setting at least one of an operating time limit, a minimum print rate, a block warming temperature, and a spit area.

25. The method of claim 24, wherein setting a spit area comprises setting at least one of bar spitting, air spitting, and fly spitting.

* * * * *

UNITED STATES PATENT AND TRADEMARK OFFICE

CERTIFICATE OF CORRECTION

PATENT NO. : 7,824,003 B2
APPLICATION NO. : 11/807469
DATED : November 2, 2010
INVENTOR(S) : Anthony D. Studer et al.

It is certified that error appears in the above-identified patent and that said Letters Patent is hereby corrected as shown below:

In column 16, line 22, in Claim 5, delete "claim 4" and insert -- claim 4, --, therefor.

Signed and Sealed this
Fifth Day of April, 2011

David J. Kappos

David J. Kappos
*Director of the United States Patent and Trademark Office*